US009511488B2

(12) United States Patent
Andrews et al.

(10) Patent No.: US 9,511,488 B2
(45) Date of Patent: Dec. 6, 2016

(54) KING PIN REMOVAL TOOL

(71) Applicant: Tiger Tool International Incorporated, Abbotsford (CA)

(72) Inventors: Michael Andrews, Bellingham, WA (US); Kirk Jansen, Abbotsford (CA)

(73) Assignee: Tiger Tool International Incorporated, Abbotsford (CA)

( * ) Notice: Subject to any disclaimer, the term of this patent is extended or adjusted under 35 U.S.C. 154(b) by 123 days.

(21) Appl. No.: 14/282,212

(22) Filed: May 20, 2014

(65) Prior Publication Data

US 2014/0345104 A1 Nov. 27, 2014

Related U.S. Application Data

(60) Provisional application No. 61/826,660, filed on May 23, 2013.

(51) Int. Cl.
*B23Q 3/06* (2006.01)
*B25B 27/02* (2006.01)

(52) U.S. Cl.
CPC ..... *B25B 27/023* (2013.01); *Y10T 29/49822* (2015.01); *Y10T 29/53865* (2015.01)

(58) Field of Classification Search
CPC .. B25B 27/00; B25B 27/0028; B25B 27/0035; B25B 27/0042; B25B 27/0064; B25B 27/023; B25B 27/064
See application file for complete search history.

(56) References Cited

U.S. PATENT DOCUMENTS

| | | | |
|---|---|---|---|
| 569,527 | A | 10/1896 | Tilton |
| 689,154 | A | 12/1901 | Bartlett |
| 1,682,956 | A | 9/1928 | Dawson et al. |
| 1,857,211 | A | 5/1932 | Odlum et al. |
| 2,052,534 | A | 8/1936 | Quarles |
| 2,374,861 | A | 5/1945 | Graham |
| 2,427,948 | A | 9/1947 | Cornwell |
| 2,484,129 | A | 10/1949 | Taylor |
| 2,549,429 | A | 4/1951 | Cowles |
| 2,681,501 | A | 6/1954 | Schrem |

(Continued)

OTHER PUBLICATIONS

Wikipedia, "Hydraulic Press," Website http://en.wikipedia.org/wiki/Hydraulic_press, p. 1.

(Continued)

*Primary Examiner* — Lee D Wilson
(74) *Attorney, Agent, or Firm* — Michael R. Schacht; Schacht Law Office, Inc.

(57) ABSTRACT

A king pin removal tool for displacing a king pin comprises a drive plate defining a drive opening, an anchor plate, a first drive member, a spacing system, and a stabilizing system. The spacing system supports the drive plate and the anchor plate relative to the king pin such that the first drive member is aligned with the king pin axis. The first drive member engages the drive plate such that rotation of the first drive member relative to the drive plate displaces the first drive member through the drive opening and along the king pin axis to displace the king pin along the king pin axis relative to the axle member and the knuckle assembly. The stabilizing system supports the drive plate to prevent rotation of the drive plate relative to the axle member when the first drive member is rotated relative to the drive plate.

22 Claims, 6 Drawing Sheets

(56) References Cited

U.S. PATENT DOCUMENTS

| | | | | |
|---|---|---|---|---|
| 2,798,392 | A | 7/1957 | Randolph | |
| 3,102,333 | A | 9/1963 | Thornton et al. | |
| 3,200,483 | A | 8/1965 | Menegoni | |
| 3,237,291 | A | 3/1966 | Kelso | |
| 3,742,570 | A | 7/1973 | Felser, Jr. | |
| 3,862,483 | A | 1/1975 | Kloster | |
| 4,195,398 | A | 4/1980 | Matthews | |
| 4,398,706 | A | 8/1983 | Kaulfuss | |
| 4,624,039 | A | 11/1986 | Lawrence et al. | |
| 4,648,166 | A | 3/1987 | Tilman | |
| 4,649,615 | A | 3/1987 | Hundley | |
| 4,672,731 | A | 6/1987 | Taylor | |
| 4,940,370 | A | 7/1990 | Gipson | |
| 4,976,280 | A | 12/1990 | Lagana | |
| 5,159,743 | A * | 11/1992 | Somerville | B25B 27/026 29/252 |
| 5,174,005 | A | 12/1992 | Somerville | |
| 5,210,919 | A | 5/1993 | Garman | |
| 5,211,211 | A | 5/1993 | Rubino et al. | |
| 5,224,254 | A | 7/1993 | McPeak et al. | |
| 5,233,741 | A | 8/1993 | Maynard | |
| 5,257,445 | A | 11/1993 | Mayberry | |
| 5,271,136 | A | 12/1993 | Skoworodko | |
| 5,341,553 | A | 8/1994 | Herzhauser | |
| 5,419,027 | A | 5/1995 | McPeak et al. | |
| 5,557,833 | A | 9/1996 | Pool | |
| 5,586,378 | A | 12/1996 | Smith | |
| 5,606,788 | A | 3/1997 | Rubino et al. | |
| 5,692,437 | A | 12/1997 | Tabain | |
| 5,839,180 | A | 11/1998 | Hochmiller | |
| 5,887,328 | A | 3/1999 | Rydin et al. | |
| 5,898,985 | A | 5/1999 | Villarreal | |
| 5,983,474 | A | 11/1999 | Koppe | |
| 6,505,390 | B2 | 1/2003 | Emanuel | |
| 6,618,920 | B1 | 9/2003 | Emanuel | |
| 6,789,791 | B2 | 9/2004 | Genduso | |
| 7,020,944 | B2 | 4/2006 | Klann | |
| 7,093,809 | B2 | 8/2006 | Hwang | |
| 7,520,041 | B1 * | 4/2009 | Aguilar | B25B 27/023 29/255 |
| 7,669,306 | B2 * | 3/2010 | Palka | B25B 27/02 29/255 |
| 7,685,688 | B2 | 3/2010 | Fan | |
| 7,818,860 | B2 | 10/2010 | Hume et al. | |
| 7,996,972 | B2 * | 8/2011 | Hu | B25B 27/026 29/252 |
| 2003/0084555 | A1 | 5/2003 | Meggiolan | |
| 2003/0106197 | A1 | 6/2003 | Emanuel | |
| 2005/0071973 | A1 | 4/2005 | Emanuel | |
| 2006/0070221 | A1 | 4/2006 | Wridt et al. | |
| 2010/0251528 | A1 * | 10/2010 | Hu | B25B 27/026 29/252 |
| 2011/0219617 | A1 | 9/2011 | Barrios et al. | |
| 2014/0345104 | A1 * | 11/2014 | Andrews | B25B 27/023 29/426.5 |

OTHER PUBLICATIONS

Greenerd, "Arbor Press History," Website http://www.greenerd.com/about-greenerd/history/default.aspx, p. 2.

Toyota, "4Runner Repair Manual, Inspection and Repair of Front Axle Hub" 1990, pp. 1 and SA-18, vol. 2, Publication No. RM143U2.

OTC, "Wheel Stud Remover/Installer," Product Brochure, 2009, 1 page, Product No. 5195.

OTC, "Wheel Stud Service Kit," Product Brochure, 2012, 1 page, Product No. 4295.

* cited by examiner

KING PIN REMOVAL TOOL

RELATED APPLICATIONS

This application, U.S. patent application Ser. No. 14/282,212 filed May 20, 2014, claims benefit of U.S. Provisional Application Serial No. 61/826,660 filed May 23, 2013, now expired, the contents of which are incorporated herein by reference.

TECHNICAL FIELD

The present invention relates to systems and methods for removing the king pin from a king pin assembly.

SUMMARY

Figure 1:
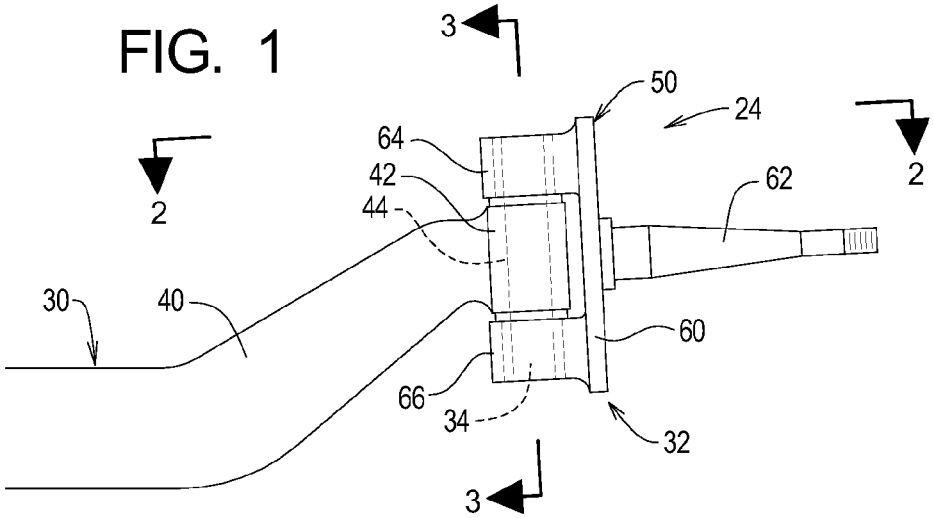
FIG. 1 is a side elevation view of an example king pin assembly.
Figure 2:
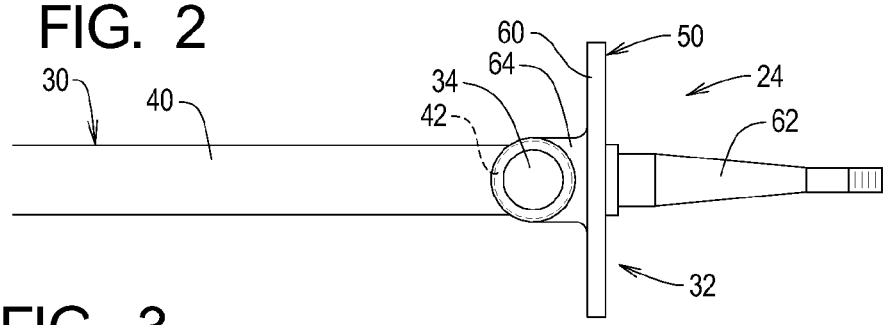
FIG. 2 is a top plan view of the example king pin assembly of FIG. 1.
Figure 3:
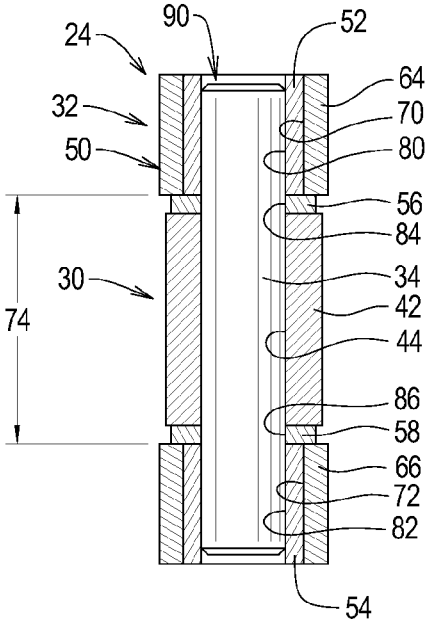
FIG. 3 is a section view taken along lines 3-3 in FIG. 1.
Figure 4:
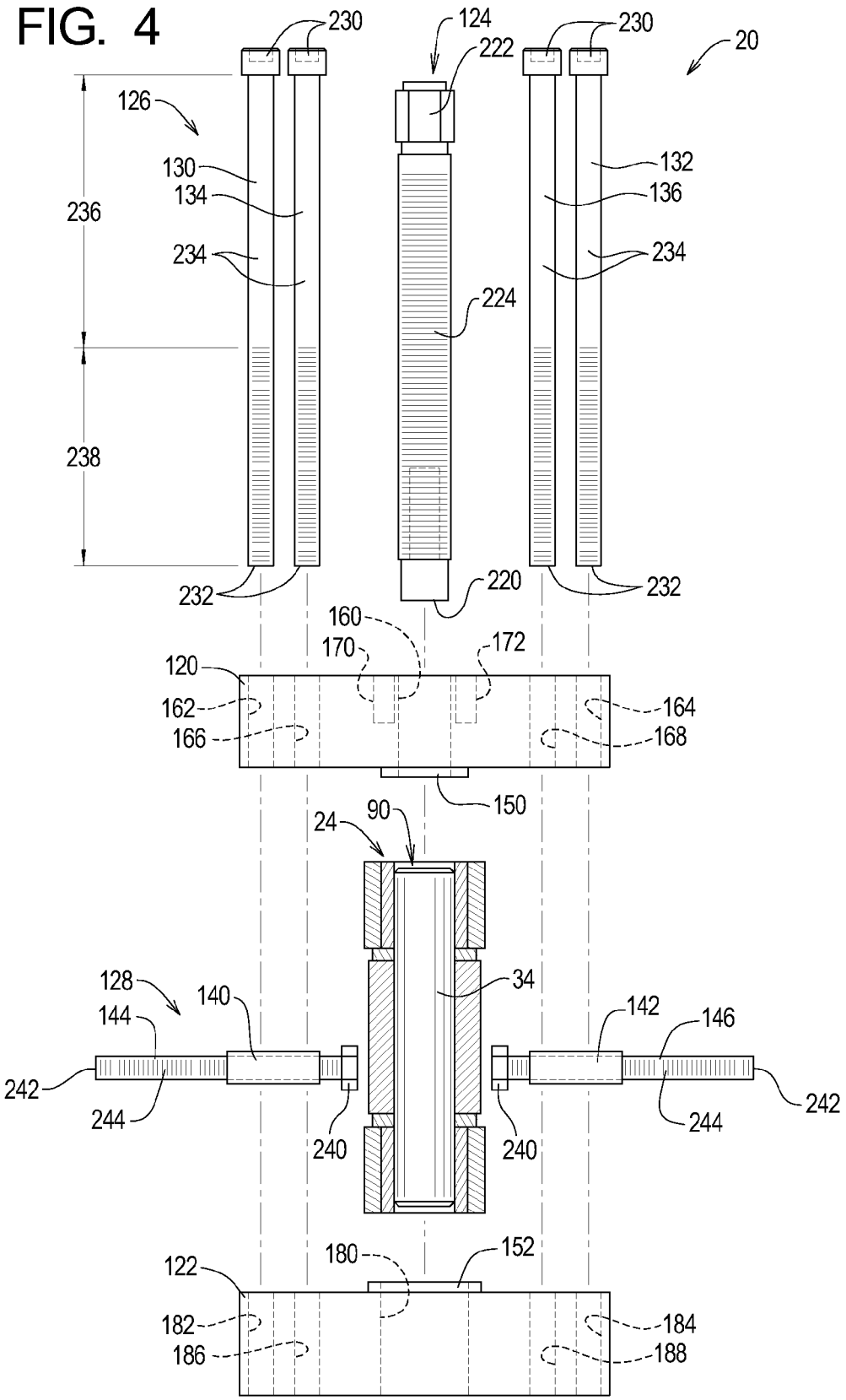
FIG. 4 is a front elevation, exploded view of a first example king pin removal tool of the present invention in a first configuration.

The present invention may be embodied as a king pin removal tool for displacing a king pin along a king pin axis relative to an axle member and a knuckle assembly comprising a drive plate defining a drive opening, an anchor plate, a first drive member, a spacing system, and a stabilizing system. The spacing system supports the drive plate and the anchor plate relative to the king pin such that the first drive member is aligned with the king pin axis. The first drive member engages the drive plate such that rotation of the first drive member relative to the drive plate displaces the first drive member through the drive opening and along the king pin axis to displace the king pin along the king pin axis relative to the axle member and the knuckle assembly. The stabilizing system supports the drive plate to prevent rotation of the drive plate relative to the axle member when the first drive member is rotated relative to the drive plate.

The present invention may also be embodied as a method of displacing a king pin along a king pin axis relative to an axle member and a knuckle assembly, the method comprising the following steps. A drive plate defining a drive opening is provided. An anchor plate is provided. The drive plate and the anchor plate are supported relative to the king pin such that the first drive member is aligned with the king pin axis. A first drive member is rotated relative to the drive plate to displace the first drive member through the drive opening and along the king pin axis to displace the king pin along the king pin axis relative to the axle member and the knuckle assembly. Rotation of the drive plate relative to the axle member is prevented when the first drive member is rotated relative to the drive plate.

The present invention may also be embodied as a king pin removal tool for displacing a king pin along a king pin axis relative to an axle member and a knuckle assembly. In this example, the king pin removal tool comprises a drive plate defining a drive opening, an anchor plate defining an exit opening, a first drive member, first and second spacing rods extending between the drive plate and the anchor plate, first and second stabilizer plates, and first and second stabilizer bolts. The first and second spacing rods support the drive plate and the anchor plate relative to the king pin such that the first drive member is aligned with the king pin axis. The first drive member engages the drive plate such that rotation of the first drive member relative to the drive plate displaces the first drive member through the drive opening and along the king pin axis to displace the king pin along the king pin axis relative to the axle member and the knuckle assembly and through the exit opening. The first spacing rod extends through the first stabilizer plate. The second spacing rod extends through the second stabilizer plate. The first stabilizer bolt extends between the first stabilizer plate and the axle member. The second stabilizer bolt extends between the second stabilizer plate and the axle member.

DETAILED DESCRIPTION

Figure 5:
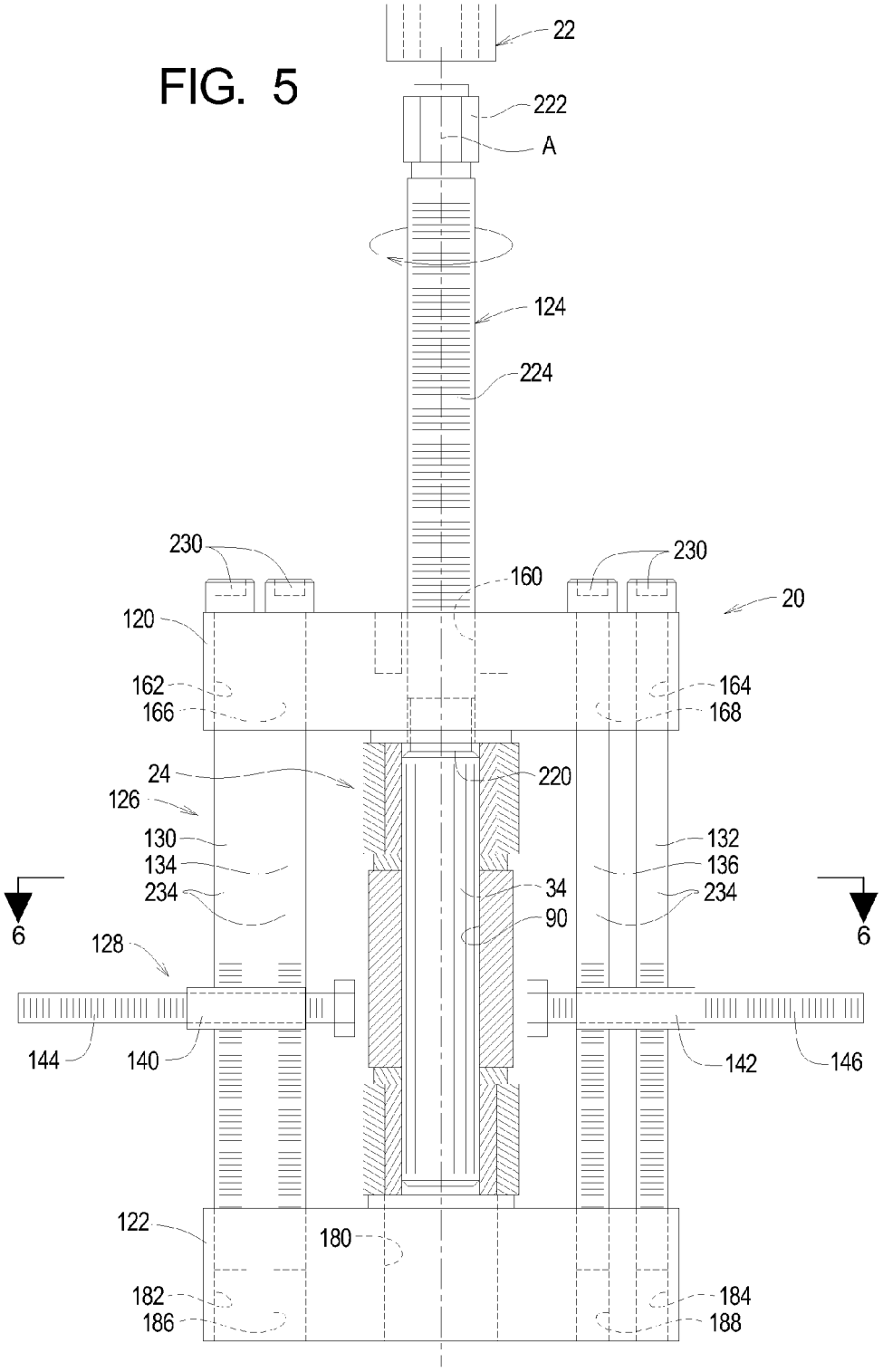
FIG. 5 is a front elevation, somewhat schematic view depicting the operation of the first example king pin removal tool in one operating position.

Referring initially to FIG. 5 of the drawing, depicted therein is a first example king pin removal tool 20. FIG. 5 illustrates the use of the first example king pin removal tool 20 with a drive system 22 and an example king pin assembly 24. The drive system 22 and king pin assembly 24 are not part of the present invention and will be described herein only to that extent necessary for a complete understanding of the present invention.

The drive system 22 is or may be any conventional tool capable of generating rotational movement and transmitting this rotational movement to the king pin removal tool as will be described in further detail below. Examples of tools that may be used as the drive system include electric, hydraulic, or pneumatic drill drivers.

King pin assemblies may be adapted for many uses and come in a variety of sizes, shapes, and configurations. A king pin removal tool constructed in accordance with the present invention may be used with many types of king pin assemblies, and the king pin assembly 24 described herein and depicted in the drawing is provided as an example only.

As best shown in FIGS. 1-3, and 5, the example king pin assembly 24 comprises an axle member 30, a knuckle assembly 32, and a king pin 34. The example king pin 34 defines a king pin axis A. The axle member 30 comprises an axle beam 40 and an axle collar 42. The axle collar 42 defines an axle opening 44. The knuckle assembly 32 comprises a knuckle 50, first and second sleeves 52 and 54, and first and second shims 56 and 58. The example knuckle 50 defines a knuckle plate 60, a stub axle 62, and first and second knuckle collars 64 and 66. The first and second knuckle collars 64 and 66 define first and second knuckle openings 70 and 72, respectively. A knuckle gap 74 is defined between the first and second knuckle collars 64 and 66. The first and second sleeves 52 and 54 define first and second sleeve openings 80 and 82, respectively. The first and second shims 56 and 58 define first and second shim openings 84 and 86, respectively.

In use, the first and second sleeves 52 and 54 are inserted into the first and second knuckle openings 70 and 72, respectively. The axle collar 42 is arranged within the knuckle gap 74 with the first shim 56 between the axle collar 42 and the first knuckle collar 64 and the second shim 58 between the axle collar 42 and the second knuckle collar 66. So arranged, the sleeve openings 80 and 82, shim openings 84 and 86, and axle opening 44 are aligned to define a king pin chamber 90. The king pin 34 is arranged within the king pin chamber 90 during normal use of the king pin assembly 24.

Turning now to FIGS. 4-7, the construction and use of the first example king pin removal tool 20 in a first configuration will now be described in further detail. The first example king pin removal tool 20 comprises a drive plate 120, an anchor plate 122, a first drive member 124, a spacing system 126, and a stabilizing system 128. The example spacing system 126 comprises first, second, third, and fourth spacing rods 130, 132, 134, and 136. The example stabilizing system 128 comprises first and second stabilizer plates 140 and 142 and first and second stabilizer bolts 144 and 146.

Turning now to the upper and anchor plates 120 and 122, it can be seen that a first alignment ring 150 is formed on the drive plate 120 and a second alignment ring 152 is formed on the anchor plate 122. A first drive opening 160 and first, second, third, and fourth through openings 162, 164, 166, and 168 are formed in the example drive plate 120. The example first drive opening 160 is threaded, and the example through openings 162, 164, 166, and 168 are unthreaded. The example drive plate 120 may optionally be provided with first and second adapter cavities 170 and 172. If used, the adapter cavities 170 and 172 are threaded. An exit opening 180 and first, second, third, and fourth anchor openings 182, 184, 186, and 188 are formed in the example anchor plate 120. The example exit opening 180 is unthreaded, and the example anchor openings 182, 184, 186, and 188 are threaded.

The example first and second stabilizer plates 140 and 142 are identical. Each of the stabilizer plates comprises a pivot opening 190, a stop notch 192, and a stabilizer rod opening 194. The example pivot openings 190 are unthreaded, and the example stabilizer rod openings 194 are threaded.

The example first drive member 124 is a rigid member defining an engaging portion 220, a drive head 222, and a drive shaft 224. The drive shaft 224 is threaded to mate with the first drive opening 160. Accordingly, with the engaging portion 220 inserted through the first drive opening 160, the drive shaft 224 engages the first drive opening 160 such that axial rotation of the first drive member 124 displaces the first drive member 124 along its longitudinal axis relative to the drive plate 120.

The example spacing rods 130, 132, 134, and 136 are identical and each define a rod head 230, a rod tip 232, and a rod shaft 234. The rod shafts 234 comprise an unthreaded portion 236 and a threaded portion 238. The unthreaded portions 236 are approximately the same diameter as the threads of the threaded portions 238 and can freely rotate within the through openings 162, 164, 166, and 168. The threaded portions 238 are sized and dimensioned to extend through the through openings 162, 164, 166, and 168 and to mate with the anchor openings 182, 184, 186, and 188. With the rod tips 232 inserted through into the anchor openings, the threaded portions 238 engage the anchor openings such that axial rotation of the spacing rods displaces the spacing rods along their longitudinal axes relative to the anchor plate 122. The rod shafts 234 are sized and dimensioned to extend through the pivot openings 190 formed in the stabilizer plates 140 and 142 such that the stabilizer plates 140 and 142 may freely rotate about the rod shafts 234.

The example stabilizer rods 144 and 146 are identical and each define a stabilizer head 240, a stabilizer end 242, and a stabilizer shaft 244. The stabilizer shafts 244 are threaded to mate with the stabilizer openings 194. With the stabilizer rods 144 and 146 arranged within the stabilizer openings 194, axial rotation of the stabilizer rods 144 and 146 relative to the stabilizer plates 140 and 142 causes longitudinal displacement of the stabilizer rods 144 and 146 relative to the stabilizer plates 140 and 142.

FIGS. 4-7 further illustrate how the first example king pin removal tool 20 may be used to remove the king pin 34 from the example king pin assembly 24. Initially, the drive and anchor plates 120 and 122 are arranged on opposite ends of the king pin chamber 90 such that the first drive opening 160 and exit opening 180 are substantially aligned with the longitudinal axis A of the king pin 34. The alignment rings 150 and 152 may optionally be provided to engage the king pin assembly 24 to facilitate alignment of the openings 160 and 180 with the king pin 34 axis.

The first and second spacing rods 130 and 132 are inserted through the first and second through openings 162 and 164 in the drive plate 120 and into the anchor openings 182 and 184 in the anchor plate 122. Axial rotation of the first and second spacing rods 130 and 132 draws the anchor plate 122 towards the drive plate 120 until the head portions 230 of the rods 130 and 132 engage the drive plate 120 and the king pin assembly 24 is clamped between drive plate 120 and the anchor plate 122.

The third and fourth spacing rods 134 and 136 are then inserted through the third and fourth through openings 166 and 168 in the drive plate 120, through the pivot openings 190 defined by the first and second stabilizer plates 140 and 142, and into the anchor openings 186 and 188 in the anchor plate 122. Axial rotation of the third and fourth spacing rods 134 and 136 forces the head portions 230 of the rods 134 and 136 against the drive plate 120 to apply additional clamping force on the king pin assembly 24 by drive plate 120 and the anchor plate 122.

Figure 6:
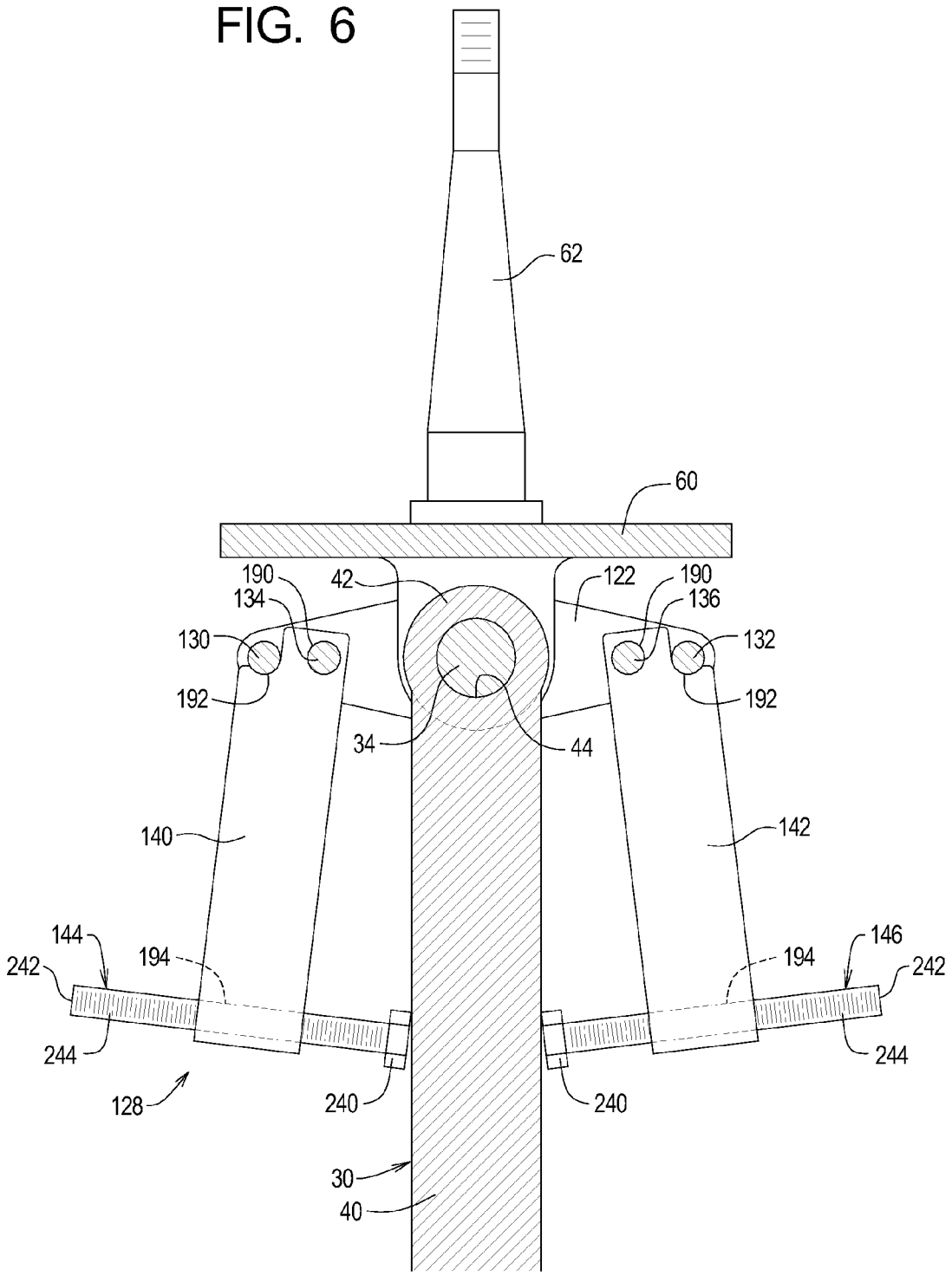
FIG. 6 is a section view taken along lines 6-6 in FIG. 5.

At this point, the first and second stabilizer plates 140 and 142 are supported for pivoting movement relative to the king pin assembly 24 by the third and fourth spacing rods 134 and 136. The stabilizer rods 144 and 146 are then axially rotated relative to the stabilizer plates 140 and 142 until the head portions 240 thereof engage the axle beam 40. Further axial rotation of the stabilizer rods 144 and 146 causes the stabilizer plates 140 and 142 to pivot about the longitudinal axes of the third and fourth stabilizer rods 134 and 136 until the stop notches 192 engage the first and second spacing rods 130 and 132 as depicted in FIG. 6. At this point, rotation of the drive plate 120 and anchor plate 122 relative to the king pin assembly 24 and in particular the king pin 34 is substantially prevented.

Figure 7:
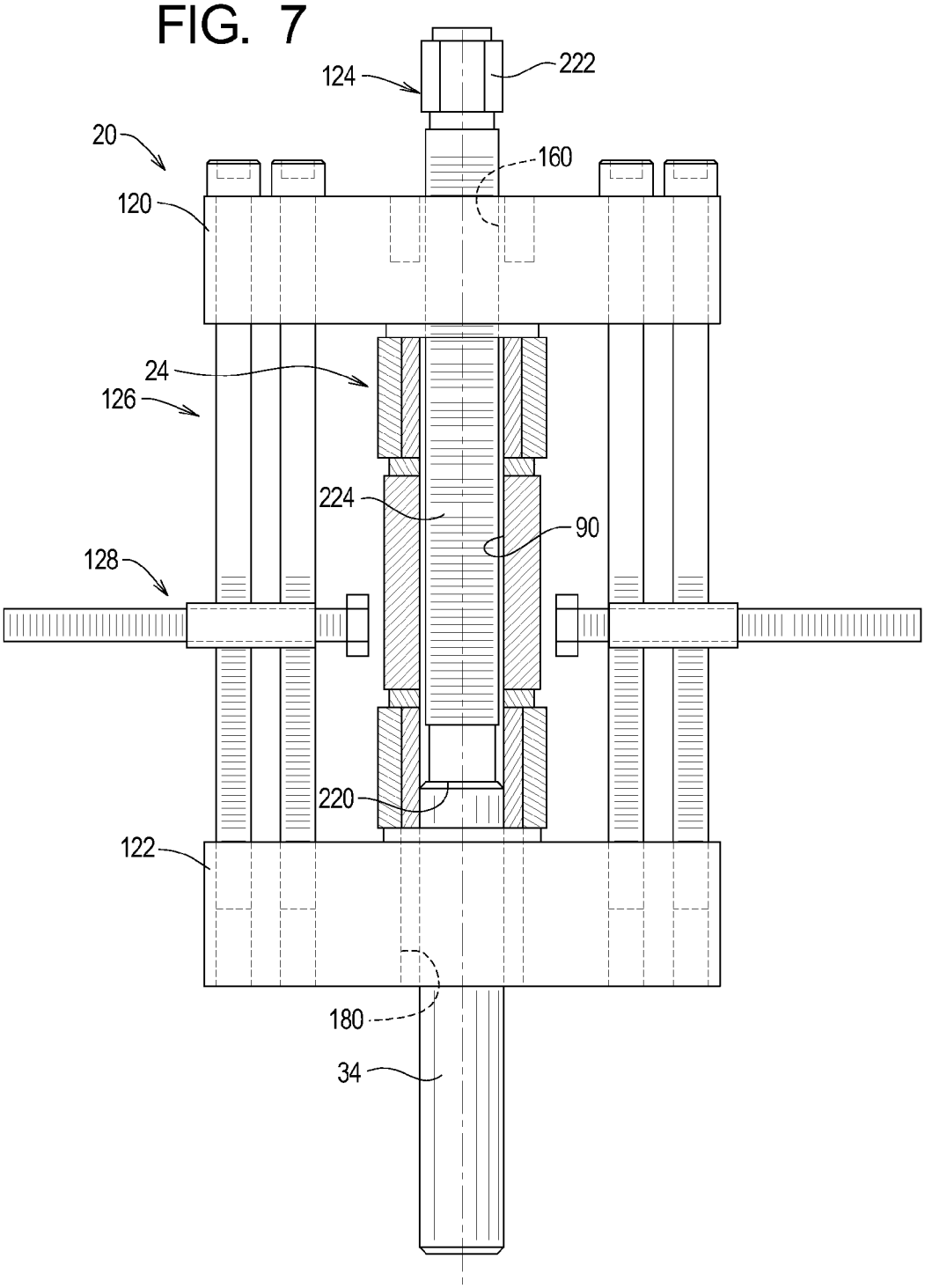
FIG. 7 is a front elevation, somewhat schematic view the first example king pin removal tool of the present invention in another operating position.

The drive tool 22 is next arranged to engage the drive head 222 of the first drive member 124. Operation of the drive tool 22 causes axial rotation of the first drive member 124, and the threaded drive shaft 224 engages the first drive opening 160 such that engaging portion 220 engages the king pin 34 as shown in FIG. 5. Continued operation of the drive tool 22 forces the king pin 34 out of the king pin chamber 90 through the exit opening 180 as shown in FIG. 7.

Figure 8:
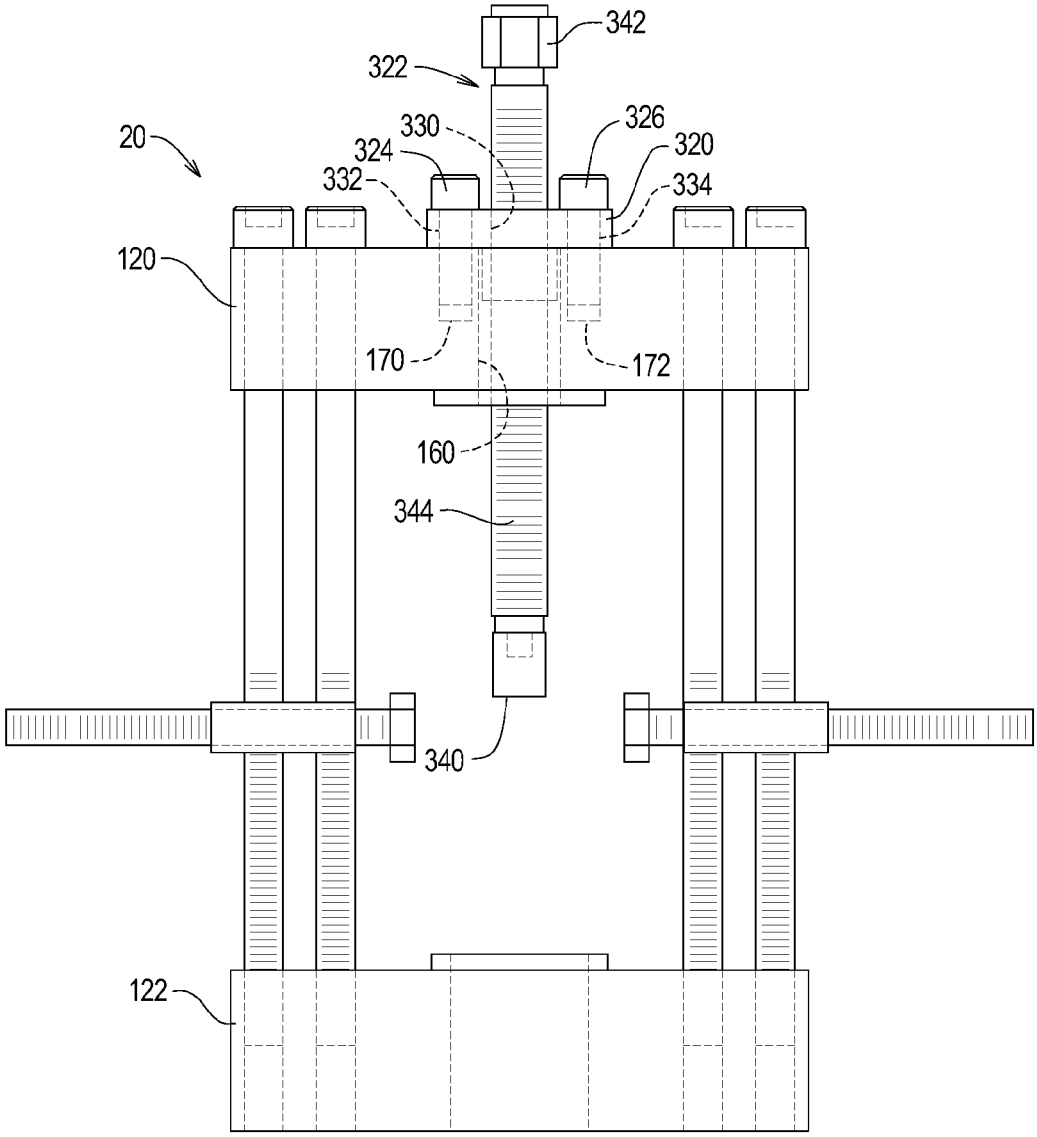
FIG. 8 is a front elevation view of the first example king pin removal tool of the present invention in a second configuration.

Referring now to FIG. 8 of the drawing, the first example king pin removal tool 20 is shown in a second configuration. In the second configuration, the example king pin removal tool is used with an adapter plate 320, a second example drive member 322, and first and second adapter bolts 324 and 326. A second drive opening 330 and first and second bolt openings 332 and 334 are formed in the adapter plate 320. The first and second adapter bolts 324 and 326 extend through the first and second bolt openings 332 and 334 and into the first and second adapter cavities 170 and 172 to secure the adapter plate 320 to the drive plate 120. The second drive opening 330 has a smaller diameter area than the first drive opening 160 and is substantially aligned with the first drive opening 160 when the adapter plate 320 is secured to the drive plate 120.

The example second drive member 322 is a rigid member defining an engaging portion 340, a drive head 342, and a drive shaft 344. The drive shaft 344 is threaded to mate with the second drive opening 330. Accordingly, with the engaging portion 340 inserted through the second drive opening 160, the drive shaft 344 engages the second drive opening 330 such that axial rotation of the second drive member 322 displaces the second drive member 322 along its longitudinal axis relative to the adapter plate 320. And because the adapter plate is rigidly connected to the drive plate 120 and the second drive opening 330 is smaller than and substantially aligned with the first drive opening 160, the engaging portion 340 passes through the first drive opening 160 when the second drive member 322 is axially rotated.

The use of the adapter plate 320 and second drive member 322 allows the first example king pin removal tool 20 in the second configuration to be used to remove a second king pin (not shown) having a smaller diameter than the first example king pin 34 depicted in the drawing.

What is claimed is:

1. A king pin removal tool for displacing a king pin along a king pin axis relative to an axle member and a knuckle assembly, the king pin removal tool comprising:
- a drive plate defining a drive opening;
- an anchor plate;
- a first drive member;
- a spacing system comprising first and second spacing rods; and
- a stabilizing system comprising
  - first and second stabilizer plates, and
  - first and second stabilizer bolts; whereby
- the spacing system supports the drive plate and the anchor plate relative to the king pin such that the first drive member is aligned with the king pin axis;
- the first drive member engages the drive plate such that rotation of the first drive member relative to the drive plate displaces the first drive member through the drive opening and along the king pin axis to displace the king pin along the king pin axis relative to the axle member and the knuckle assembly;
- the first spacing rod extends through the first stabilizer plate;
- the second spacing rod extends through the second stabilizer plate;
- the first stabilizer plate support the first stabilizer bolt;
- the second stabilizer plate supports the second stabilizer bolt; and
- the first and second stabilizer plates are arranged such that the first and second stabilizer bolts apply opposing forces on the axle member such that the stabilizing system prevents rotation of the drive plate relative to the axle member when the first drive member is rotated relative to the drive plate.

2. A king pin removal tool as recited in claim 1, in which:
- the first drive member defines an externally threaded portion;
- the drive plate defines an internally threaded portion; and
- the externally threaded portion engages the internally threaded portion such that axial rotation of the first drive member causes displacement of the first drive member through the drive opening.

3. A king pin removal tool as recited in claim 1, in which the spacing system comprises at least one spacing member that extends between the drive plate and the anchor plate to maintain a desired relationship between the drive plate and the anchor plate.

4. A king pin removal tool as recited in claim 1, in which the spacing member holds the drive plate and the anchor plate against the knuckle assembly.

5. A king pin removal tool as recited in claim 1, in which:
- the drive plate defines first and second through openings; and
- the anchor plate defines first and second anchor openings; wherein
- to fix a spatial relationship between the drive plate and the anchor plate,
  - the first spacing rod extends through the first through opening and engages the first anchor opening; and
  - the second spacing rod extends through the second through opening and engages the second anchor opening.

6. A king pin removal tool as recited in claim 1, in which rotation of at least one spacing rod clamps the knuckle assembly between the drive plate and the anchor plate.

7. A king pin removal tool as recited in claim 5, in which:
- the spacing system further comprises third and fourth spacing rods;
- the drive plate further defines third and fourth through openings; and
- the anchor plate further defines a third and fourth anchor openings; wherein
- the third spacing rod extends through the third through opening and engages the third anchor openings; and
- the fourth spacing rod extends through the four through opening and engages the fourth anchor openings.

8. A king pin removal tool as recited in claim 1, in which the stabilizing system engages the spacing system to prevent rotation of the drive plate relative to the axle member when the first drive member is rotated relative to the drive plate.

9. A king pin removal tool as recited in claim 1, in which:
- the first stabilizer plate engages a first structure support relative to the drive plate to inhibit rotation of the first stabilizer plate about the first spacing rod; and
- the second stabilizer plate engages a second structure supported relative to the drive plate to inhibit rotation of the second stabilizer plate about the second spacing rod.

10. A king pin removal tool as recited in claim 5, in which the spacing system comprises:
- the first stabilizer plate engages the third spacing rod to inhibit rotation of the first stabilizer plate about the first spacing rod; and
- the second stabilizer plate engages the fourth spacing rod to inhibit rotation of the second stabilizer plate about the second spacing rod.

11. A king pin removal tool as recited in claim 1, in which:
- a first stabilizer head of the first stabilizer bolt engages the axle member;
- a second stabilizer head of the second stabilizer bolt engages the axle member;
- the first stabilizer bolt is supported by the first stabilizer plate such that axial rotation of the first stabilizer bolt displaces the first stabilizer head relative to the first stabilizer plate; and the second stabilizer bolt is supported by the second stabilizer plate such that axial rotation of the second stabilizer bolt displaces the second stabilizer head relative to the second stabilizer plate.

12. A king pin removal tool as recited in claim 1, in which the first and second stabilizing bolts engage opposing sides of the axle member to prevent rotation of the drive plate relative to the axle member when the first drive member is rotated relative to the drive plate.

13. A king pin removal tool as recited in claim 1, further comprising:

a second drive member; and an adapter plate; whereby the drive plate is adapted to support the adapter plate and the second drive member engages the adapter plate such that rotation of the second drive member relative to the drive plate displaces the second drive member through the drive opening and along the king pin axis.

14. A king pin removal tool as recited in claim 1, in which the anchor plate defines an exit opening, where the first drive member displaces the king pin member through the exit opening.

15. A king pin removal tool for displacing a king pin along a king pin axis relative to an axle member and a knuckle assembly, the king pin removal tool comprising:

a drive plate defining a drive opening;

an anchor plate defining an exit opening;

a first drive member;

first, second, third, and fourth spacing rods extending between the drive plate and the anchor plate;

first and second stabilizer plates; and first and second stabilizer bolts; whereby the first, second, third, and fourth spacing rods support the drive plate and the anchor plate relative to the king pin such that the first drive member is aligned with the king pin axis;

the first drive member engages the drive plate such that rotation of the first drive member relative to the drive plate displaces the first drive member through the drive opening and along the king pin axis to displace the king pin along the king pin axis relative to the axle member and the knuckle assembly and through the exit opening;

the first spacing rod extends through the first stabilizer plate such that the first stabilizer plate rotates relative to the first spacing rod;

the first stabilizer plate engages the third spacing rod to inhibit rotation of the first stabilizer plate;

the second spacing rod extends through the second stabilizer plate such that the second stabilizer plate rotates relative to the second spacing rod;

the second stabilizer plate engages the fourth spacing rod to inhibit rotation of the second stabilizer plate;

the first stabilizer bolt extends between the first stabilizer plate and a first side of the axle member;

the second stabilizer bolt extends between the second stabilizer plate and a second side of the axle member; and the first and second stabilizer bolts apply opposing forces on the axle member to prevent rotation of the drive plate during rotation of the first drive member relative to the drive plate to displace the first drive member through the drive opening and along the king pin axis.

16. A king pin removal tool as recited in claim 15, in which:

the first drive member defines an externally threaded portion;

the drive opening in the drive plate is internally threaded; and the first drive member engages the drive opening such that axial rotation of the first drive member causes displacement of the first drive member through the drive opening.

17. A king pin removal tool as recited in claim 15, in which the first, second, third, and fourth spacing rods hold the drive plate and the anchor plate against the knuckle assembly.

18. A king pin removal tool as recited in claim 15, in which:

the drive plate defines first, second, third, and fourth through openings; and the anchor plate defines first, second, third, and fourth anchor openings; wherein to fix a spatial relationship between the drive plate and the anchor plate, the first spacing rod extends through the first through opening and engages the first anchor opening;

the second spacing rod extends through the second through opening and engages the second anchor opening the third spacing rod extends through the third through opening and engages the third anchor opening;

the fourth spacing rod extends through the fourth through opening and engages the fourth anchor opening.

19. A king pin removal tool as recited in claim 15, in which rotation of first, second, third, and fourth spacing rod clamps the knuckle assembly between the drive plate and the anchor plate.

20. A king pin removal tool as recited in claim 15, in which:

a first stabilizer head of the first stabilizer bolt engages the axle member;

a second stabilizer head of the second stabilizer bolt engages the axle member;

the first stabilizer bolt is supported by the first stabilizer plate such that axial rotation of the first stabilizer bolt displaces the first stabilizer head relative to the first stabilizer plate; and the second stabilizer bolt is supported by the second stabilizer plate such that axial rotation of the second stabilizer bolt displaces the second stabilizer head relative to the second stabilizer plate.

21. A king pin removal tool as recited in claim 15, further comprising:

a second drive member; and an adapter plate; whereby the drive plate is adapted to support the adapter plate and the second drive member engages the adapter plate such that rotation of the second drive member relative to the drive plate displaces the second drive member through the drive opening and along the king pin axis.

22. A king pin removal tool as recited in claim 15, in which the anchor plate defines an exit opening, where the first drive member displaces the king pin member through the exit opening.

* * * * *